United States Patent [19]

Wilcox et al.

[11] 4,217,801

[45] Aug. 19, 1980

[54] SOLO SUSTAIN KEYER SYSTEM

[75] Inventors: Brian N. Wilcox, Kettering, Ohio; John W. Robinson, Jasper, Ind.

[73] Assignee: Kimball International, Inc., Jasper, Ind.

[21] Appl. No.: 962,003

[22] Filed: Nov. 20, 1978

[51] Int. Cl.[2] ..... G10H 1/02

[52] U.S. Cl. ..... 84/1.01; 84/1.26; 84/DIG. 8; 84/DIG. 11; 84/DIG. 23

[58] Field of Search ..... 84/1.01, 1.03, 1.13, 84/1.17, 1.24, 1.26, DIG. 8, DIG. 11, DIG. 23

[56] References Cited

U.S. PATENT DOCUMENTS

| | | | |
|---|---|---|---|
| 3,902,397 | 9/1975 | Morez et al. | 84/1.01 |
| 4,116,102 | 9/1978 | Tsunoo et al. | 84/1.01 |
| 4,129,055 | 12/1978 | Whittington et al. | 84/1.17 |
| 4,144,787 | 3/1979 | Robinson et al. | 84/1.01 |
| 4,147,085 | 4/1979 | Robinson et al. | 84/1.01 |

*Primary Examiner*—J. V. Truhe
*Assistant Examiner*—William L. Feeney
*Attorney, Agent, or Firm*—Albert L. Jeffers; John F. Hoffman

[57] ABSTRACT

An integrated keyer system for use in electronic organs comprising a plurality of discrete integrated circuit chips each corresponding to two adjacent octaves of the keyboard and connected in series to accommodate the entire keyboard. The keyer system is adapted for use in multiplexed systems wherein the keyswitch closure information is encoded in a time division multiplexed data stream fed through a plurality of the keyer chips, which are connected in series. Each of the keyer chips includes a plurality of tone inputs and outputs and a divide-by-four circuit for lowering the tones in by two octaves. The keyer chips also include serial data inputs and outputs and a demultiplexer for demultiplexing the serial data stream at the serial data input to produce a plurality of control signals corresponding to keydown signals in the serial data stream, which are fed to the individual keyers. The demultiplexer, which may be in the form of a shift register having latches connected between the various stages thereof and the keyers, also serves to delay the serial data stream by two octaves. The keyer chips have their tone inputs and outputs connected in series with the tone input of the first keyer being connected to the tone generator means. The serial data inputs and outputs are also connected in series so that the data stream is fed through the entire bank of chips in series before the data is latched into the keyers. The keyers are of the pseudo sustain type, in which the charge from one capacitor is incrementally transferred to another capacitor to produce the rise and decay for the keying envelope, and are controlled by a pair of counters having variable effective count lengths. The counters are controlled by means of tri-level inputs over a number of the tone input lines. By also connecting the tone inputs and outputs in series and lowering the frequency by two octaves in each chip, the tones feeding the divider/keyer circuit are at the proper frequency for the particular octaves in question.

23 Claims, 11 Drawing Figures

MASTER TONE GENERATOR
12 TONES OUT
SUSTAIN SWITCHES (BINARY ENCODED)
ATTACK SWITCHES (BINARY ENCODED)
TL
KEYER CHIP #1
KEYER CHIP #2
KEYER CHIP #3
12 TONES IN
12 TONES OUT
S.D. IN
S.D. OUT
LATCH
HF CK/R
7 BIT SHIFT REG
BUSS AMPLIFIERS AND WAVE FORMING CIRCUITS
SERIAL DATA
SERIAL DATA OUT
VOICING
TABS
AMP
HF CLOCK
RESET
LATCH MULTIPLEXER
KEYBOARD

16' LOW OUT
16' HIGH OUT
8' LOW OUT
8' HIGH OUT
4' LOW OUT
4' HIGH OUT
2' LOW OUT
2' HIGH OUT
KEYER
TONE
ENVELOPE
TONE OUT ÷4
LOW OCTAVE ENVELOPE GENERATOR C# LO
HIGH OCTAVE ENVELOPE GENERATOR C# HI
VENV.
HIGH OCTAVE KEYING SIGNAL
LOW OCTAVE KEYING SIGNAL
TONE IN
MR
VDD'

1K
2K
4K
10 K
10K
LPF
16'
8'
4'
2'
16'-1
16'-2
16'-3
16'-4
8'-1
8'-2
8'-3
8'-4
4'-1
4'-2
4'-3
4'-4
2'-1
2'-2
2'-3
2'-4
302
304
306
308
310
312
314
316
318
320
322
324
326
328
330
332

SOLO SUSTAIN KEYER SYSTEM

BACKGROUND OF THE INVENTION

The present invention relates to a keyer system for electronic organs and other keyboard electronic musical instruments, and in particular to a keyer system comprised of a plurality of discrete keyer circuits which are connected in series in building block form so as to accommodate the entire keyboard.

In prior art electronic organs, sustain or percussive keying has been a continual problem from the standpoint of balancing performance and cost. This is due in great part to the necessity of a sustain system which requires elements which indirectly control the audio signal as compared to key switches which directly control it and are relatively low in cost. Furthermore, the elements traditionally used for sustain keying are quite large physically, are costly and require tuning and adjustment. In the past, diodes and neon lamps have been utilized to perform the indirect control element function, with electrolytic capacitors being used for envelope shaping.

With the rapid growth of solid-state electronics, field effect transistor keyers have been widely utilized to perform the indirect control element function, but the sustain system has still often required large external capacitors, with the concomitant problems of matching and balancing. Furthermore, a great number of integrated circuit pins have been required, usually many times greater than the customary maximum of forty pins per chip. This necessitates assembling a large number of integrated circuit chips thereby requiring a large printed circuit board or wiring area to make the necessary interconnections.

Because of the nature of the key switching system used to control the sustain system, slow attack has been very difficult to incorporate at a reasonable cost. Switching of sustain lengths has at times required the use of power transistor switches which adds cost and heat to the system.

Many of these problems have been overcome by the keyer system disclosed in co-pending Application Ser. No. 892,385 filed Mar. 31, 1978 in the name of John W. Robinson wherein the charge on one capacitor is incrementally transferred to another capacitor and therefore to the keyer control terminal by rapidly and alternately switching a pair of FET's.

With a sixty-one key manual, and even with smaller manuals such as those having forth-four keys, a great deal of wiring or printed circuit board is required for interconnecting the large number of keyers which are required. This adds cost to the system and makes servicing and maintenance of the circuitry difficult. Even where a number of keyers are contained within a single integrated circuit chip, the limitation of having forty or less external pins for controlling the chip and providing the necessary inputs and outputs for the tones and keydown data is a problem without sacrificing flexibility and features of the organ.

SUMMARY OF THE INVENTION

The present invention overcomes the disadvantages and problems of the prior art by integrating in a single discrete chip sustain-type keyers for two adjacent octaves of the keyboard. The keyer chips may be interconnected in building block fashion to accommodate forty-four note or sixty-one note manuals, and may be expanded even further to accommodate organs having even larger keyboard capacity. Further expansion of this by adding more keyer chips allows expansion of the keyer system to permit the use of a flute shifter principle as described in U.S. Pat. No. 3,951,028. The individual keyer chips may be manufactured such that they are identical to each other, thereby imparting a flexibility and universality to the system which is effective in minimizing manufacturing and replacement costs and greatly simplifies servicing.

The keyers are of the pseudo sustain/attack variety wherein the length of attack and decay is controlled by the rate at which the FET's are cycled. This is controlled by means of a pair of counters wherein the effective count lengths thereof are controlled by means of tri-level inputs coming into the chip over certain of the tone input pins. Since the tone inputs and outputs for the chips are connected in series, the tri-level sustain and attack selection information is carried throughout without the necessity for providing additional external tri-level encoders for each chip. The sustain and attack selection data is binary encoded so that four types of sustain and two types of attack may be selected on only three input lines.

Each octave of each footage is brought out separately in a rank type configuration, thereby allowing a highly flexible output structure adaptable for low cost as well as high performance organs. By properly combining the outputs, 16', 8' or 4' staircase waves can be formed. Alternatively, the various footages can be converted to sine waves for use in producing flute tones.

Specifically, the present invention is related to a keyer system for use in electronic organs having a keyboard with playing keys, a multiplexer for scanning the keys and developing a serial data stream having keydown signals in time slots corresponding to depressed ones of the keys, and a tone generator for producing a plurality of tones. The keyer system comprises a plurality of keying circuits each corresponding to the keys of at least one octave, each of the keying circuits comprising a plurality of tone inputs and a plurality of tone outputs, a divider for dividing the tone at the inputs so as to lower them by at least one octave, a serial data input connected to receive the serial data stream and a serial data output, a demultiplexer for demultiplexing the serial data stream to produce a plurality of control signals corresponding to the keydown signals in the data stream, serial data delay means for delaying the data stream by at least one octave and placing the delayed data stream on the serial data output, and a keyer bank controlled by the control signals and receiving the input tones for producing on the plurality of output lines tones corresponding to the control signals. The dividing circuits tone inputs and outputs are connected in series with the tone input of the first dividing circuit being connected to the tone generator and the inputs of successive dividing circuits in the series being connected to the tone outputs of the dividing circuit immediately preceding them. The keying circuit serial data inputs and outputs are also connected in series such that the data stream flows through the keying circuits in series and is successively delayed by the respective delay means.

The pseudo sustain keyers comprise a control terminal, keyboard controlled means for selectively supplying a keyer actuating voltage to the control terminal, a plurality of envelope generators interposed between the keyboard controlled means and the keyer and comprising an input terminal connected with the keyer actuating voltage, an output terminal connected with the control terminal of the respective keyer, first means for storing a voltage, second means connected to the output terminal for storing a voltage and holding the output terminal at the last mentioned voltage, third variable conductivity means connected between the first means and the input terminal for providing, when actuated, a path between the input terminal and the first means whereby the voltage level at the input terminal can be transferred to the first means, and fourth variable conductivity means connected between the first and second means and providing, when actuated, a path between the first and second means whereby the voltage level at the first means can be transferred to the second means. The improvement constitutes means for repetitively and alternately actuating the third and fourth variable conductivity means to transfer the voltage level at the input through the first voltage storage means to the second voltage storage means by increments over a period of time, which comprises: a clock driven counter having its output connected to the third and fourth variable conductivity means for actuating the same, and means for varying the effective count length of the counter so as to vary the rate at which the third and fourth means are repetitively and cyclically actuated.

It is an object of the present invention to provide a keyer system for electronic organs and the like wherein a number of the individual keyers are integrated in a single chip and a plurality of such chips are connected together in building block fashion until all of the keys of the keyboard are accomodated.

It is a further object of the present invention to provide a keyer system for electronic organs and the like wherein the number of interconnections between circuit components is substantially reduced without sacrificing performance or features.

A still further object of the present invention is to provide a keyer system for electronic organs and the like which may be easily and inexpensively mass produced and assembled, and which greatly reduces the difficulty of servicing.

These and other objects and features of the present invention will become apparent from the detailed description thereof together with the accompanying drawings.

BRIEF DESCRIPTION OF THE DRAWINGS

FIG. 6 is a schematic of one possible output configuration for producing staircase wave outputs for the various footages;

FIG. 9 is a block diagram of the keyer system according to the present invention for a forty-four note manual, and FIG. 10 is a modified demultiplexing arrangement.

DETAILED DESCRIPTION

Figure 1:
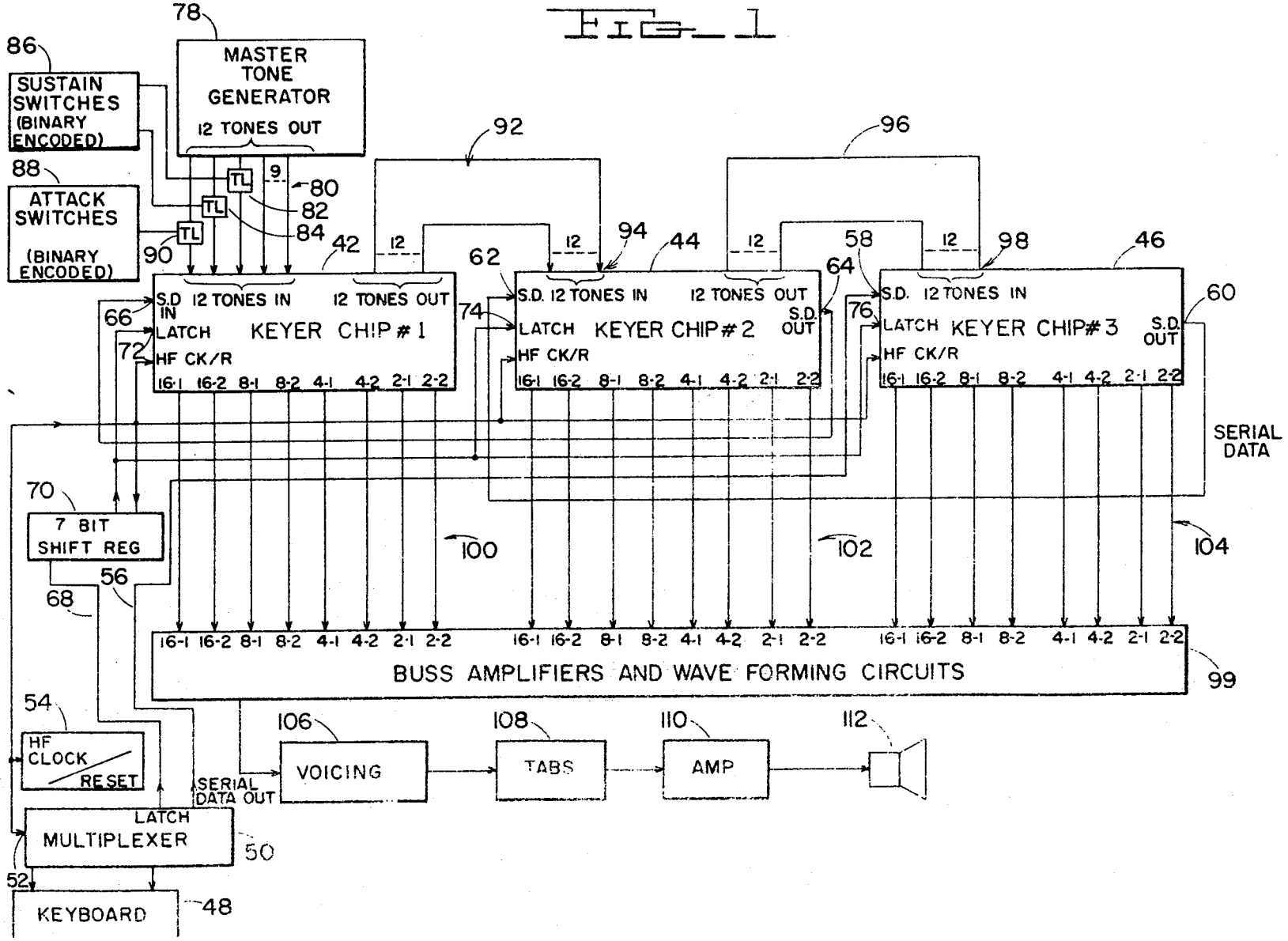
FIG. 1 is a block diagram of the keyer system according to the present invention for a sixty-one note manual.

Referring now to FIG. 1, the keyer system of the invention configured for a sixty-one note manual is illustrated. It comprises three keyer chips 42, 44 and 46, which are connected in series. Keyboard 48 is multiplexed by conventional multiplexer 50, which is clocked over line 52 by means of high frequency clock/reset circuit 54 having a single tri-level output whereby the clocking and reset functions can be combined on a single line.

The data stream on line 56 produced by multiplexer 50 contains time slots corresponding on a one-to-one basis with the keys of keyboard 48 and containing keydown signals, customarily in the form of pulses, in time slots corresponding to depressed ones of the keys of keyboard 48. This time division multiplexed data stream is fed to the serial data input 58 of keyer chip 46 in which it is delayed two octaves and then fed out on the serial data output 60. Each of keyer chips 42 and 44 corresponds to two adjacent octaves of keyboard 48 and it is for this reason that the serial data stream is delayed by time slots equaling two octaves. Keyboard 48 is preferably scanned in a downward direction beginning with the highest key and ending with the lowest key thereof, and it is for this reason that the serial data stream is first fed to keyer chip 46.

The delayed serial data stream on output 60 is fed to the serial data input 62 of the second keyer chip 44, delayed by a period of two octaves, and fed out on output 64 to the serial data input 66 of the first keyer chip 42. In each of chips 42, 44 and 46, the serial data stream flows through a twenty-four bit shift register for demultiplexing and delay purposes. At the end of the scan of manual 48, multiplexer 50 produces a latch signal on line 68, which is delayed seven bits by shift register 70 before being fed to the latch inputs 72, 74 and 76 of chips 42, 44 and 46, respectively, in order to permit the data stream to reach the last stage of the shift register in chip 42, for a sixty-one note manual. The necessity for this will be discussed in greater detail hereinafter. At this time, chip 42 contains the first two octaves of the data stream, chip 44 the next two octaves of the data stream, and chip 46 the fifth octave and one note of the last octave. The signals on latch inputs 72, 74 and 76 cause the internal latches to be clocked thereby transferring the keydown data to the individual keyers.

The tones are generated by a master tone generator 78 and supplied to keyer chip 42 over twelve input lines 80. Two of these lines have tri-level encoders 82 and 84 connected therein which encode the tone signals with the binary encoded sustain switch data from switches 86, thereby avoiding the necessity for utilizing a separate pair of pins for switches 86. In a similar fashion, attack switches 88, which are also binary encoded, are fed into chip 42 on the same line with one of the tones by means of tri-level encoder 90.

The twelve tones, which may be produced by top octave synthesizing or individual oscillators, are in the 8,000 Hz. to 4,000 Hz. range. The tones on lines 80 are divided by a factor of four in chip 42 so as to lower them by two octaves and then fed out on lines 92 to the tone input pins 94 of the second keyer chip 44. These tones are further divided in frequency by a factor of four so as to lower them two octaves and fed out over lines 96 to the tone input lines 98 of the third keyer chip 46. By this successive frequency division of the tones, they are at the proper frequencies for the octaves related to the respective chips 42, 44 and 46.

Chips 42, 44 and 46 each include pseudo sustain-type keyers wherein the keying envelope is selected by means of switches 86 and 88. The keyed tones at a footage for each of the pitches of the respective octaves are bused together and fed to bus amplifiers and wave forming circuits 99 over lines 100, 102 and 104 for chips 42, 44 and 46, respectively. The outputs from the bus amplifiers and wave forming circuits 99 are fed to voicing circuits 106 through tabs 108 and then through amplifier 110 to speaker 112.

Figure 2:
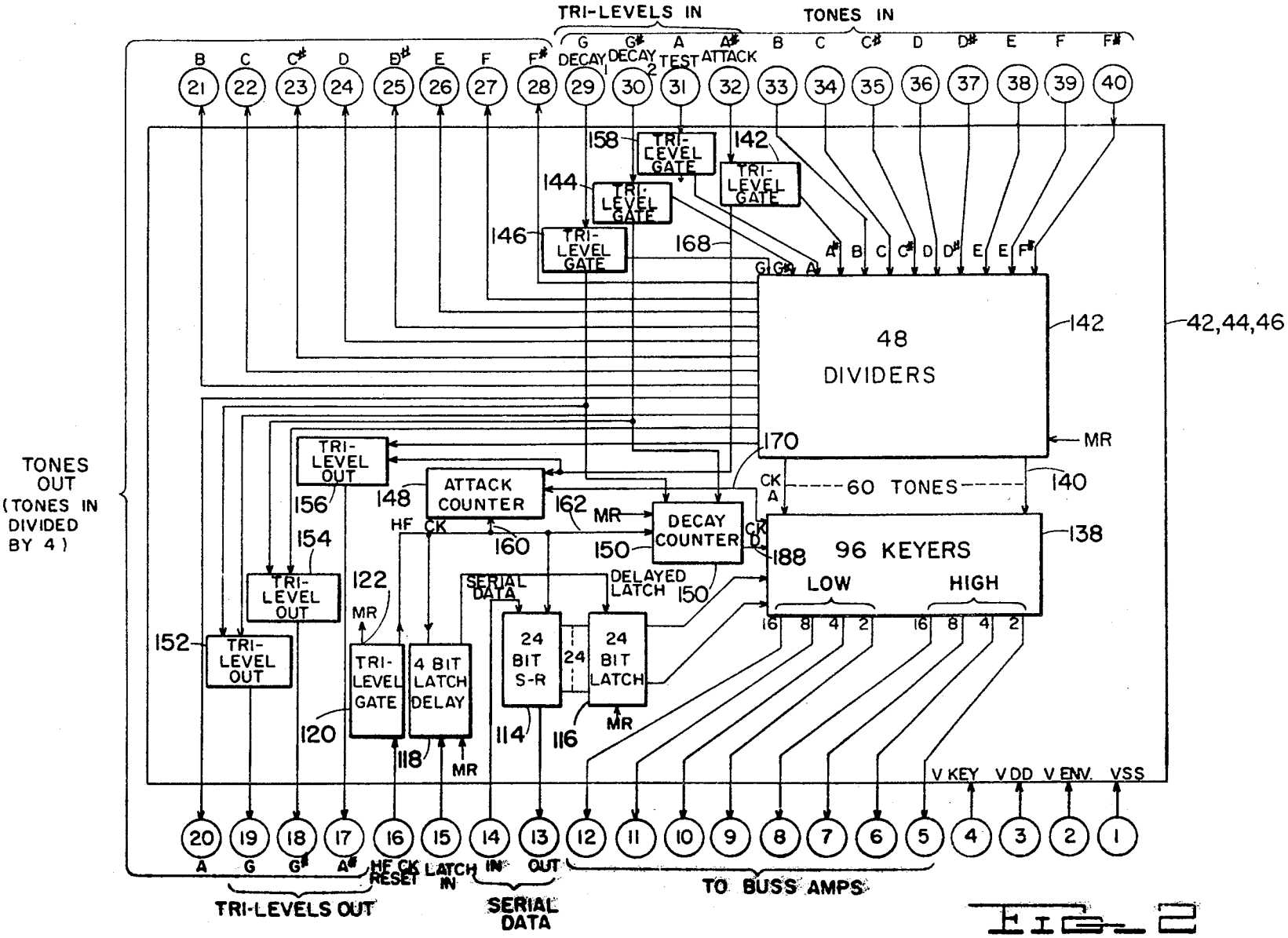
FIG. 2 is an internal block diagram of one of the keyer chips represented in FIG. 1.

Referring now to FIG. 2, one of the chips 42, 44 and 46 is shown in greater detail. The serial data stream on pin 14, which may be received either directly from multiplexer 50 or from the serial data output pins of one of the other keyer chips 42, 44 or 46, is fed into twenty-four bit shift register 114, which in turn feeds a twenty-four bit latch 116. Latch 116 receives the latch command from four bit latch delay 118, which in turn is fed by the latch signal from multiplexer 50 on pin 15, and is clocked by the high frequency clock train brought in on pin 16 and decoded by tri-level gate 120. The four bit delay for the latch signal caused by delay 118 together with the seven bit delay caused by shift register 70 is necessary for a sixty-one note manual because the three twenty-four bit shift registers for chips 42, 44 and 46 cumulatively represent seventy-two time frames. For a forty-four note manual wherein only two keyer chips are utilized (FIG. 9), the seven bit shift register is not necessary and the four bit latch delay 118 alone will enable the pulse train to reach the last stage of the shift register in the last chip before the data is transferred to the keyers.

Figure 3:
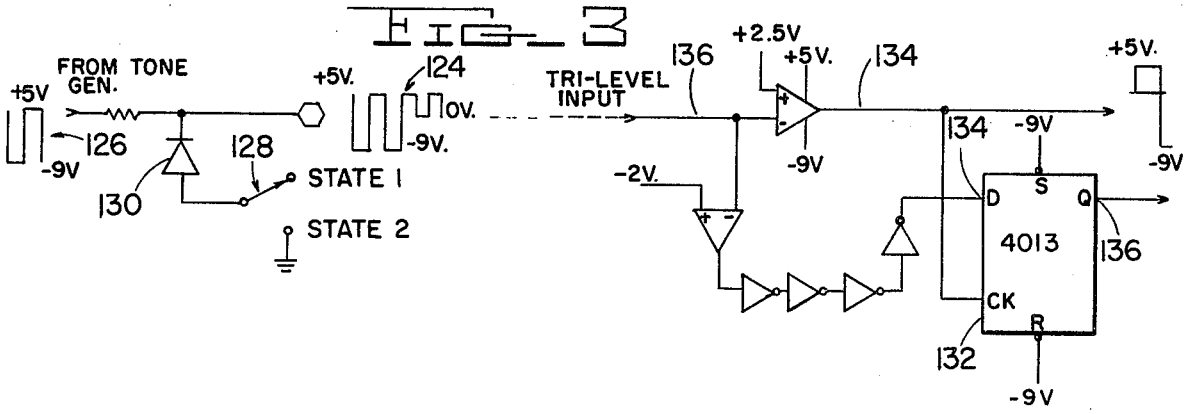
FIG. 3 is a schematic diagram of tri-level input and output circuits.

The master reset on line 122 is separated out by tri-level gate 120, an example of which is shown in FIG. 3. The tri-level signal 124 is produced by combining a high frequency signal, such as tone signal 126, with a static signal such as that produced by switch 128 as it switches between states 1 and 2. In state 2, diode 130 clamps the tone swing between +5 v. and 0 v., whereas in state 1, tone signal 126 is permitted its full swing between 5 v. and −9 v. Decoding of the static signal may be accomplished by means of D-type flip-flop 132, which is clocked by the signal on line 134 and transfers the −9 v. signal on the D terminal 134 to the Q output 136 when the tri-level input on line 136 swings to −9 v.

Latch 116 feeds a twenty-four section pseudo sustain envelope generator 138 generally of the type disclosed in the aforementioned co-pending Application Ser. No. 892,385. Envelope generators/keyers 138 are fed with sixty tones over lines 140 from forty-eight dividers 142, which produce the five octaves of tones necessary for the 16', 8', 4' and 2' footages for the two adjacent octaves keyed by the particular keyer chip 42, 44 or 46. Dividers 142 receive the twelve tones for a single octave over pins 29–40 and, in addition to performing the above-discussed frequency division, pass these tones to keyers 138 and to tone output pins 17–28. Tri-level gates 142, 144 and 146 separate out the attack and sustain commands for attack and decay counters 148 and 150, and tri-level encoders 152, 154 and 156 re-encode this data on tone output pins 17, 18 and 19. Tri-level gate 158 separates a test signal from the A tone.

Figure 4:
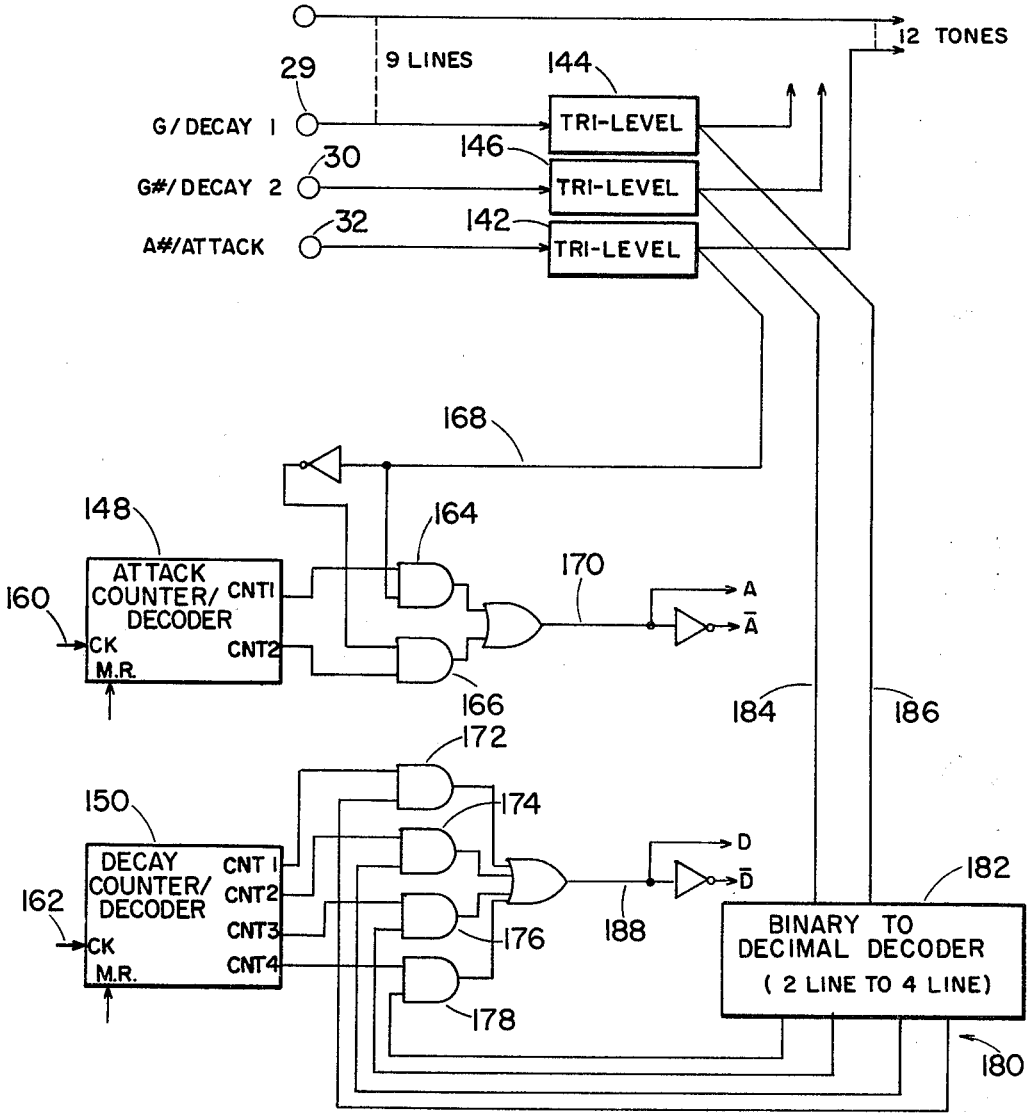
FIG. 4 is a more detailed schematic of the attack and sustain control circuit for the keyers.

With reference to FIG. 4, the circuitry for selecting the effective count lengths of counters 148 and 150 is shown. Counters 148 and 150, which may be of the polynomial counting type, shift register type, binary type or decimal type, are clocked by the high frequency clock pulse trains on lines 160 and 162 from tri-level decoder 120.

Attack counter/decoder 148 has two outputs $CNT_1$ and $CNT_2$ which are connected respectively to one of the inputs of AND gates 164 and 166, the other inputs of which are fed by the inverted and non-inverted logic levels on line 168 leading from tri-level gate 142. With the $CNT_1$ output being the shortest count, when the logic level on line 168 is logic 1, AND gate 164 will be enabled and the pulse train on line 170 will be at the higher frequency. Conversely, when the logic level on line 168 is logic 0, AND gate 166 will be enabled and the pulse train on line 170 will be at the lower frequency. It should be noted that counter/decoder 148 may have more than two outputs with $CNT_1$ and $CNT_2$ being any two of those outputs so that the relative frequencies may have a ratio other than 2:1. The pulse train on line 170 is fed to one of the inputs of the circuit shown on FIG. 5 in both its inverted and non-inverted form.

Sustain counter/decoder 150 has four outputs shown, $CNT_1$, $CNT_2$,$CNT_3$ and $CNT_4$, which are fed respectively to one of the inputs of AND gates 172, 174, 176 and 178. As was the case with counter/decoder 148, $CNT_1$ represents the shortest count length and $CNT_4$ the longest count length with $CNT_2$ and $CNT_3$ lying therebetween. $CNT_1$–$CNT_4$ need not be four consecutive counts of counter 150 but may be spaced as required by the particular sustaining characteristics which are to be achieved. The other inputs of AND gates 172, 174, 176 and 178 are fed by outputs 180 from binary to decimal decoder 182. Decoder 182 is fed by a two bit binary word on lines 184 and 186 produced by tri-level gates 144 and 146. Depending on which one of AND gates 172, 174, 176 and 178 is enabled, the pulse train on line 188 will have a corresponding higher or lower frequency and, thus, four different sustains can be selected depending on the logic levels on pins 29 and 30. The pulse train on line 188 is fed to one of the inputs of the circuit shown in FIG. 5 in both its inverted and non-inverted forms.

Counter/decoders 148 and 150 feed twenty-four banks of four keyers each, wherein each of the four keyers produces one of the footages required by that particular note, for example, the 16', 8', 4' and 2' footages. The 2' keyers are weighted with 2R keyers so as to have a half amplitude to provide a staircase directly paralleled with the 4'.

Figures 5, 5A:
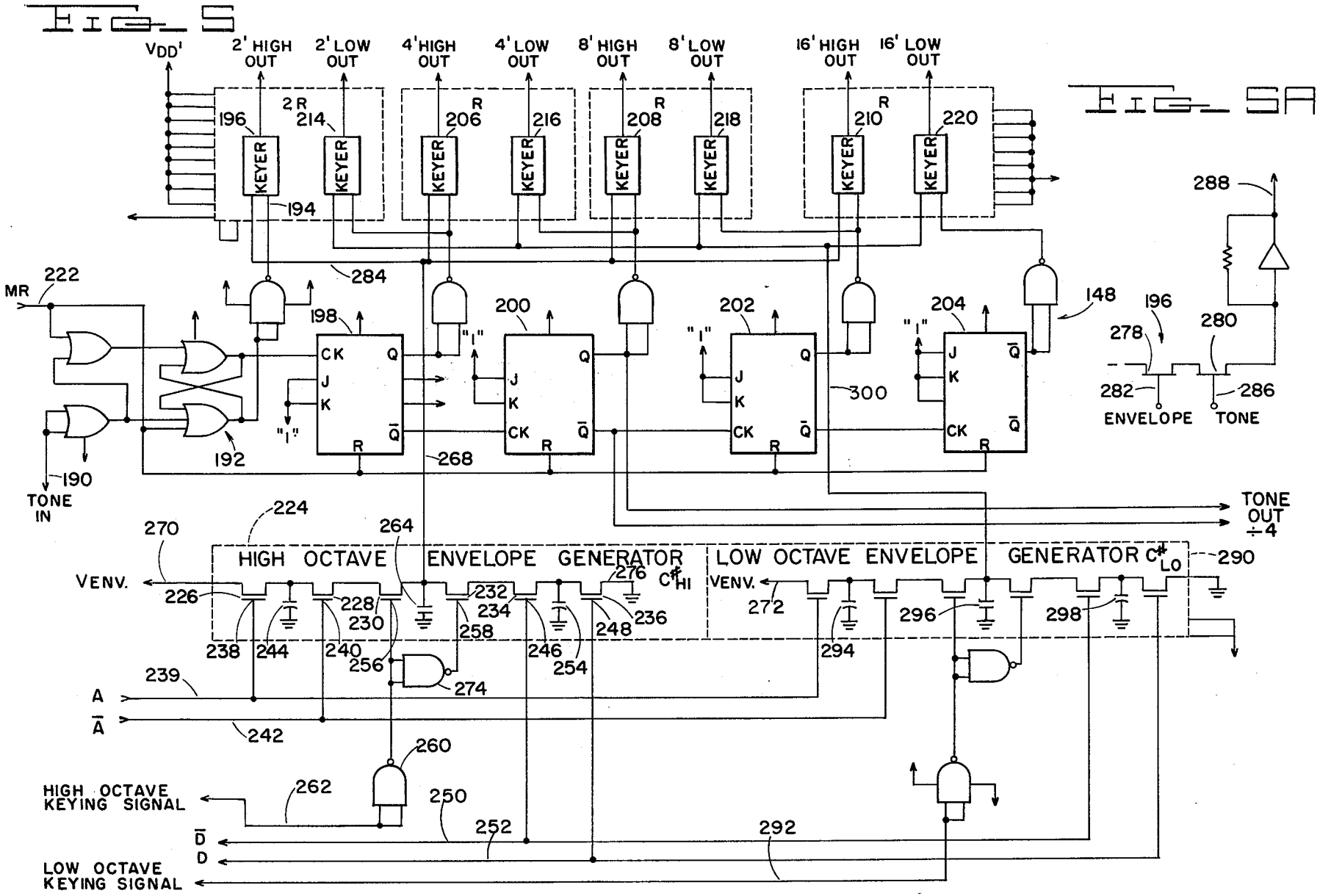
FIG. 5 is a detailed schematic of a portion of one of the divider/keyer blocks shown in FIG. 2.
FIG. 5A is a more detailed schematic of one of the individual keyers.

Referring now to FIG. 5, a portion of the keyer/divider combination 138, 142 shown generally in FIG. 2 will be described in detail. The tone, for example the C# tone in the highest octave, is fed in from pin 35 on line 190 into R/S driver 192, which feeds the tone to one of the inputs 194 of individual keyer 196. The tone is also fed through a series of divide-by-two dividers 198, 200, 202 and 204 which present tones at one of the inputs to keyers 206, 208 and 210 at the 4', 8' and 16' pitches. The 2', 4', 8', and 16' pitches for the C# tone in the next octave lower are accomplished by tying together the tone inputs of the 2' lower octave keyer 214 and the 4' higher octave keyer 206, by tying together the tone inputs of the 4' lower octave keyer 216 and the 8' higher octave keyer 206, and by tying together the tone inputs of the lower octave 8' keyer 218 and the 16' higher octave keyer 210. The 16' lower octave keyer 220 is fed directly by divider 204. The master reset is brought in on line 222.

Envelope generator 224 for the higher octave C# tone comprises FETs 226, 228, 230, 232, 234 and 236 having their sources and drains connected in series. The gate terminal 238 for FET 226 is fed by the non-inverted A output from attack counter 148 on line 239, whereas the gate 240 for FET 228 is fed by the inverted output $\overline{A}$ from attack counter 148 on line 242. FET's 226 and 228 have a 0.001 microfarad capacitor 244 connected between their juncture and ground. The gates 246 and 248 of FET's 234 and 236 are controlled by the inverted and non-inverted pulse trains on lines 250 and 252, respectively, from decay counter 150. A 0.001 microfarad capacitor 254 is connected between the juncture of FET's 234 and 236.

The gates 256 and 258 of FET's 230 and 232 are controlled by the non-inverted and inverted outputs, respectively, from NAND gate 260 and when a keydown signal on line 262 is received from one of the latches 116 designating a particular depressed key on keyboard 48, FET 230 will be enabled. Similarly, when the key is released and the opposite logic level is present on line 262, FET 230 will be disabled and FET 232 enabled. Thus, the attack characteristics are controlled by the frequency of the signals on lines 239 and 242, and the relative capacitances of capacitors 244 and 264, the latter being connected between the juncture of FET's 230 and 232 and ground and having a value of 0.47 microfarads, for example. The keying envelope is connected to the other inputs of keyers 196, 206, 208 and 210 over line 268.

The VENV adjust on lines 270 and 272 is controlled by a potentiometer (not shown) external to the chips 42, 44 and 46 and serves to set the keyer current and attack-/decay time.

When a keydown signal is received on line 262, FET 230 will be turned on thereby providing a high conductivity path between FET 228 and capacitor 264. As FET 226 opens and closes, the voltage on line 270 will incrementally charge capacitor 244. Similarly, as FET 228 switches on and off, the voltage on capacitor 244 will discharge into capacitor 264 thereby raising the voltage level on line 268 incrementally and gradually over a period of time. As the FETs continue to oscillate between their on and off states, the voltage on capacitors 244 and 264 will gradually charge towards the voltage level on line 270. The time interval required for the voltage on capacitor 264 to charge fully is determined by the frequency of the signal on lines 239 and 242, as developed by variable count length attack counter 144, and by the ratio values, rather than the particular sizes, of capacitors 244 and 264.

When the key is released and the logic level on line 262 returns to the opposite level, FET 230 will be disabled and FET 232 will be enabled, due to the inverting function of NAND gate 274, so that there is a path of high conductivity between FET 234 and capacitor 264. As FET's 234 and 236 are alternately enabled by the out-of-phase pulse trains on lines 250 and 252, capacitor 264 will incrementally discharge into capacitor 254, and capacitor 254 will discharge through FET 236 to ground on line 276. Thus, the voltage level on line 268 will gradually return to the lower voltage level so as to disable keyers 196, 206, 208 and 210.

It should be noted that the choice of the VENV voltage on line 270 as being a positive voltage and the voltage on line 276 being ground potential, and the grounding of capacitors 244, 264 and 254 is simply for the purposes of illustration. A number of combinations of voltage levels are possible depending on the type of circuitry and logic utilized. For example, capacitors 244 and 254 could be held in a charged state and then discharged during attack and recharged during decay.

FIG. 5A shows one possibility for keyers 196, 214, 206, 216, 208, 218, 210 and 220. Referring to keyer 196, for example, it comprises a pair of FET's 278 and 280 connected in series wherein the gate 282 of FET 278 is connected to line 284, which in turn is connected to control line 268 from enveloper generator 224. The gate 286 of FET 280 is connected to line 194, which carries the highest frequency footage tone from line 190. Thus, when a tone is present on line 194 and a positive keying voltage on line 268, the keyed tone will appear on line 288, which is connected to bus amplifiers and wave forming circuits 99. When the key is released, and the voltage on line 268 decays out, keyer 196 will be turned off. Of course, this is only one example of a suitable keyer and other keyers could be utilized.

The lower octave envelope generator 290 functions identically to envelope generator 224 and is controlled by the keying signal on line 292. Again, the attack characteristics are controlled by the frequency of the pulse trains on lines 239 and 242 and the ratio of capacitors 294 and 296. The decay characteristics are controlled by the frequency of the pulse trains on lines 250 and 252 and the ratio of capacitors 298 and 296. In this case, however, line 300 carries the keying signal and actuates keyers 214, 216, 218 and 220 which pertain to the next lower octave.

Figures 5, 7, 8:
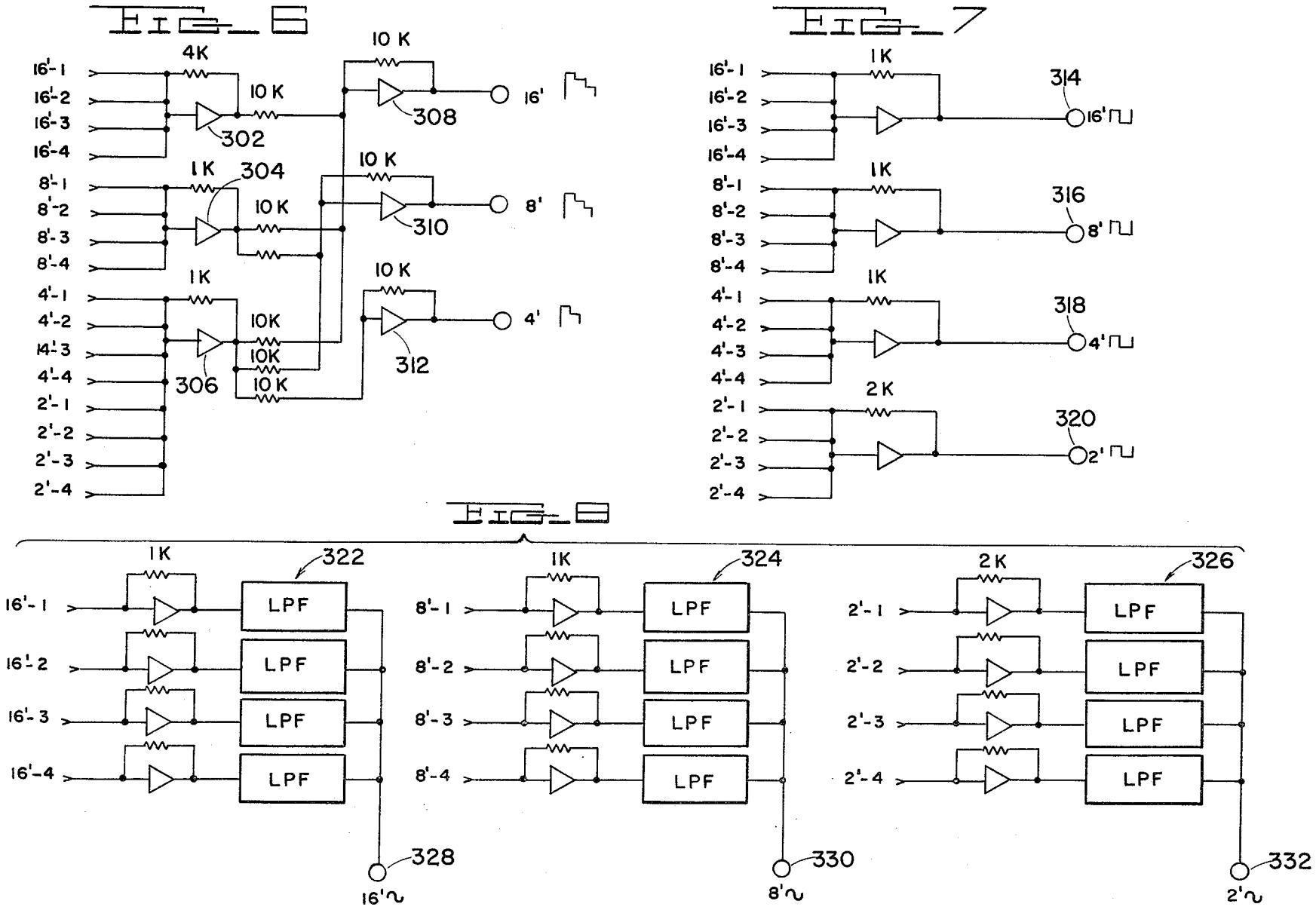
FIG. 7 is a schematic of another possible output configuration for producing square wave tones for the various footages on separate output buses.
FIG. 8 is a schematic diagram of another output configuration wherein bused sine waves are produced.
Figure 5:
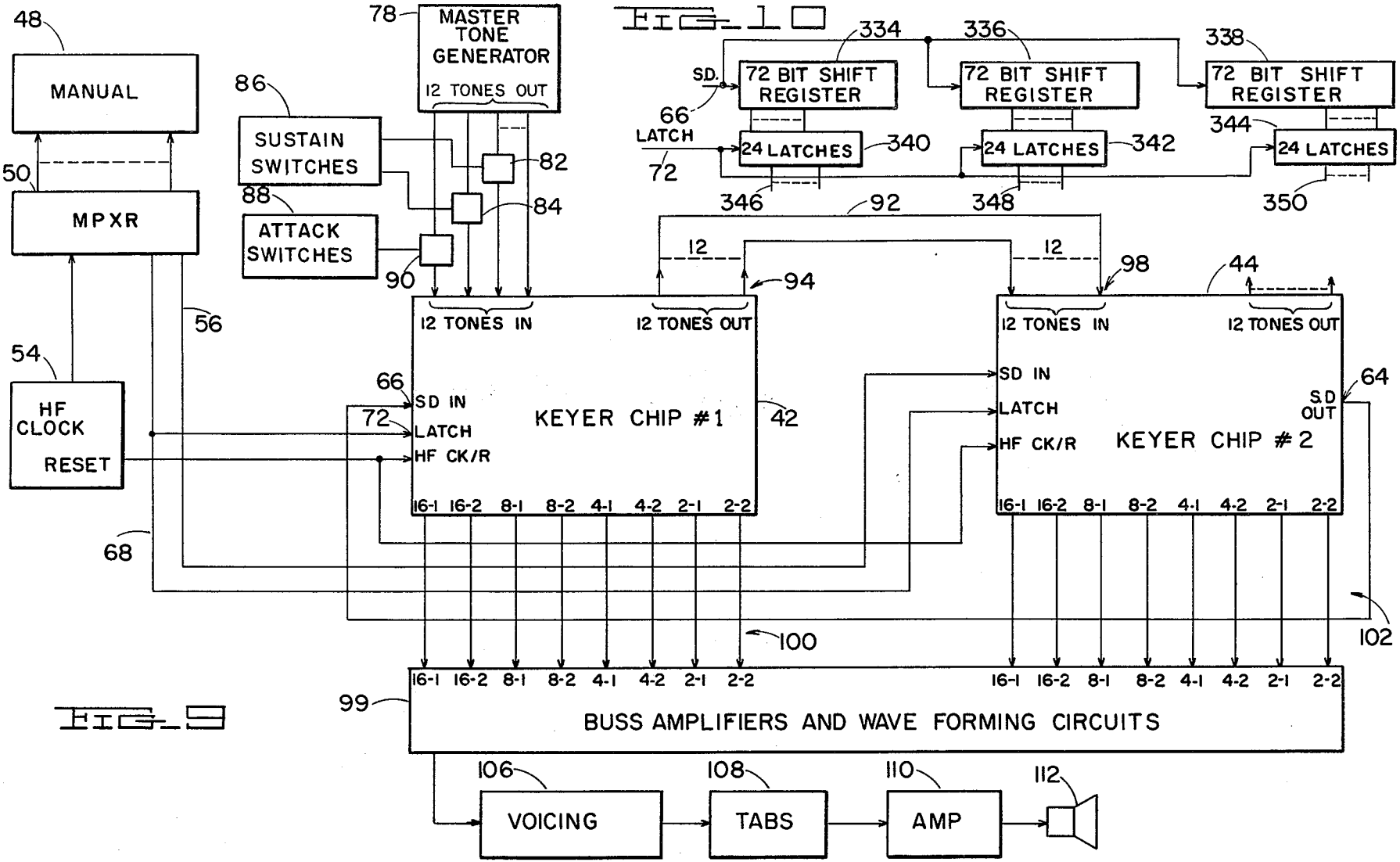

Referring to FIGS. 6, 7 and 8, a number of possible output configurations are shown. If it is desired to generate 16', 8' and 4' staircase waves, the 16' tones are bused, the 8' tones are bused, and the 2' (2R) and 4' tones are bused together. These outputs are amplified by their respective bus amplifiers 302, 304 and 306 with the 16' being amplified by twice as much as the 8' and four times as much as the 4' combination. These, when added together in the appropriate summing amplifier 308, 310 and 312, produce the 16', 8' and 4' staircase waves. The 4' staircase is a two component staircase.

If it is desired to produce square waves at the various footages, the individual footages for the octaves are bused together and fed out on separate lines 314, 316, 318 and 320. The 2' tones are amplified twice as much as the 4', 8' and 16' tones, so as to bring the level of the 2R keyer up to the same as the others and allows these to be used for clarinet voicing and the like.

If it is desired to produce flute tones, the individual footages are filtered by low pass filters 322, 324 and 326, summed and then fed out on lines 328, 330 and 332.

By relatively simple remasking, the keyers can be configured for non-octave related footages such as 1 3/5', $2\frac{2}{3}$', 1'. Furthermore, by proper tone input, the chips can be used for any octave related footage such as $1\frac{1}{3}$', $2\frac{2}{3}$', $5\frac{1}{3}$', etc., without remasking.

FIG. 9 illustrates the keyer system of the present invention configured for a forty-four note manual. Wherever possible, identical reference numerals have been used for corresponding elements. Instead of three keyer chips, only two chips 42 and 44 are provided with the serial data output 64 from chip 44 being fed into the serial data input 66 of chip 42. As discussed earlier, the four bit latch signal delay 118 in each of chips 42 and 44 enables the serial data stream to be in proper position before the data is latched. Obviously, as many keyer chips 42, 44 and 46 may be provided as necessary to encompass the entire keyboard.

With reference to FIG. 10, demultiplexing may be accomplished without delaying the serial data stream by two octaves in each of the keyer chips. For example, 72 bit shift registers 334, 336 and 338 may be provided in keyer chips 42, 44 and 46, respectively, with the serial data stream from line 66 being connected to each of the serial data inputs in parallel. Groups of twenty-four latches 340, 342 and 344 are connected to the first twenty-four stages of shift register 334, to the second twenty-four stages of shift register 336 and to the last twenty-four stages of shift register 338, respectively. The latch command from line 72 is connected to the clocking inputs of the latches 340, 342 and 344, also in parallel. What occurs is that the serial data stream is shifted simultaneously through the shift registers 334, 336 and 338 but only that portion of the serial data stream corresponding to the octaves pertaining to the respective keyer chips 42, 44 and 46 will be latched by the respective latches 340, 342 and 344. The outputs 346, 348 and 350 of latches 340, 342 and 344 carry the keydown control signals for controlling the appropriate keyers 138. For a sixty-one note manual, only the first thirteen of latches 344 would be used.

Although latches 340, 342 and 344 have been shown as being hard wired to the respective stages of shift registers 334, 336 and 338, an alternative arrangement would provide identical FET steering logic circuits connected to all of the stages of the respective shift registers 334, 336 and 338. Appropriate binary input control signals would then program the steering logic to select the appropriate twenty-four stages of the shift register for connection to the twenty-four output lines 346, 348 and 350. By this arrangement, the keyer chips 42, 44 and 46 could be identical, thereby being capable of universal application in the "building block" manner as preferred by the present invention.

Many modifications to the system are possible depending on the desires of the programmer. For example, by the incorporation of another tri-level input, top octave folding can be incorporated selectively so as to maintain the output within the four kilohertz to eight kilohertz range. If the folds are selectively incorporated, they can be disabled by simply not allowing the chip to fold, thus allowing it to be used up to a 1' unfolded output.

If the mutated footage system is utilized, it would be paralleled to the present system in all except the outputs. The serial data would be interconnected and tied to the same multiplexer serial data out, the latch and high frequency clocks would run from the same points, and the chips would be fed from the same tone generating system with the same attack and decay switching. If desired, independent attack and decay could be employed by adding two tri-level controls.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. In an electronic organ or the like having a keyboard with playing keys, multiplexer means for scanning the keys and developing a serial data stream having keydown signals in time slots corresponding to depressed ones of the keys and tone generator means for producing a plurality of tones, a keyer system comprising:

a first keyer-divider circuit comprising a plurality of first tone inputs, first demultiplexer means having a serial data input connected to receive the serial data stream for demultiplexing the serial data stream and producing control signals corresponding respectively to the keydown pulses in one portion of said data stream, first keyer means responsive to said control signals and connected to receive tones on said tone inputs for producing on a plurality of output lines tones corresponding to said control signals, and serial data output means for delaying said data stream by at least one octave, and a second keyer-divider circuit comprising a plurality of second tone inputs connected to receive said plurality of tones, a plurality of tone outputs, divider means connected between said second tone inputs and said tone outputs for producing at the outputs tones corresponding to the tones on the second inputs lowered by at least one octave, second demultiplexer means having a serial data input connected to said first keying circuit serial data output means for demultiplexing the delayed serial data stream and producing second control signals corresponding respectively to the keydown signals in another portion of the delayed serial data stream, and second keyer means connected to receive said second control signals and said plurality of tones for producing on a plurality of output lines tones corresponding to said second control signals, said first tone inputs being connected to said second keyer-divider circuit tone outputs.

2. The electronic organ of claim 1 wherein said first demultiplexer means includes a shift register having its input connected to receive said first mentioned serial data stream, and said means for delaying said serial data stream comprises a serial data output from said shift register on which said delayed serial data stream appears.

3. The electronic organ of claim 2 wherein said second demultiplexer means includes a shift register having its input connected to receive said delayed serial data stream, and said demultiplexer means includes latches connected between said shift registers and the respective first and second keyer means.

4. The electronic organ of claim 1 wherein said first keyer-divider circuit includes a plurality of tone outputs, divider means connected between said first keyer-divider circuit tone inputs and outputs for producing at said last mentioned tone outputs tones corresponding to the tones on the last mentioned tone inputs lowered by at least one octave, and said second keyer-divider circuit includes second serial data output means for delaying said delayed serial data stream by at least one octave.

5. The electronic organ of claim 1 wherein each said keyer means includes a plurality of envelope generators each comprising: a control terminal, a source of potential, at least two serially connected first and second variable conductivity control elements forming a branch serially connected between said source of potential and said control terminal, a first capacitor connected between the juncture of said elements and a reference potential, a second capacitor connected to said control terminal, and control means for cyclically maintaining the conductivity of said first element at a high level while at the same time maintaining the conductivity of said second element at a low level and then maintaining the conductivity of said second element at a high level while at the same time maintaining the conductivity of said first element at a low level so as to cause said first means to charge through one of said elements and discharge through the other element each cycle of said control means.

6. The electronic organ of claim 5 wherein said control means includes variable length counter means for cycling said control elements at a selected one of a plurality of rates.

7. In an electronic organ or the like having a keyboard with playing keys, multiplexer means for scanning the keys and developing a serial data stream having keydown signals in time slots corresponding to depressed ones of the keys, and tone generator means for producing a plurality of tones, a keyer system comprising:

a first keyer-divider circuit comprising a plurality of first tone inputs adapted to receive a plurality of first tones, first demultiplexer means having a serial data input connected to receive said serial data stream for demultiplexing the serial data stream and producing control signals corresponding respectively to the keydown pulses in a portion of said data stream, first keyer means responsive to said control signals and connected to receive tones on said first tone inputs for producing on a plurality of output lines tones corresponding to said control signals, and serial data output means for delaying said serial data stream by at least one octave, a second keyer-divider circuit comprising a plurality of second tone inputs adapted to receive a plurality of second tones, a plurality of second tone outputs connected to said first tone inputs, divider means connected between said second tone inputs and outputs for producing on the second tone outputs said first tones corresponding to the second tones on said second tone inputs lowered by at least one octave, second demultiplexer means having a serial data input connected to said first keyer-divider circuit serial data output means for demultiplexing the delayed serial data stream and producing second control signals corresponding respectively to the keydown pulses in another portion of the delayed serial data stream, second keyer means connected to receive said second control signals and said plurality of second tones for producing on a plurality of output lines tones corresponding to said second control signals, and serial data output means for delaying said delayed data stream by at least one octave, and a third keyer-divider circuit comprising a plurality of third tone inputs connected to receive said plurality of tones from said tone generator means, a plurality of third tone outputs connected to said second tone inputs, divider means connected between said third tone inputs and outputs for producing on said third tone outputs said second tones corresponding to the tones on said third tone inputs lowered by at least one octave, third demultiplexer means having a serial data input connected to said second keying circuit serial data output means for demultiplexing the further delayed serial data stream and producing third control signals corresponding respectively to the keydown pulses in a third portion of the twice delayed serial data stream, and third keyer means connected to receive said third control signals and said plurality of tones from said tone generator means for producing on a plurality of output lines tones corresponding to said third control signals.

8. The electronic organ of claim 7 wherein each of said keyer-divider circuits includes means for producing tones corresponding to at least one octave and the tones on their respective said output lines correspond to a plurality of footages for each of the pitches of the respective octaves.

9. In an electronic organ or the like having a keyboard with playing keys, multiplexer means for scanning the keys and developing a serial data stream having keydown signals in time slots corresponding to depressed ones of the keys, and tone generator means for producing a plurality of tones, a keyer system comprising:

a plurality of keyer-divider circuits each corresponding to the keys of at least one octave, each of said keyer-divider circuits comprising: a plurality of tone inputs and a plurality of tones outputs, divider means for dividing tones at the tone inputs so as to lower them by at least one octave, a serial data input connected to receive said serial data stream and a serial data output, demultiplexer means for demultiplexing said serial data stream to produce a plurality of control signals corresponding to keydown signals in the data stream, and keyer means controlled by said control signals and receiving the tones on said tone inputs for producing on a plurality of output lines tones corresponding to said control signals, said keyer-divider circuits tone inputs and outputs being connected in series wherein the tone input of the first keying circuit is connected to the tone generator means and the tone inputs of successive said keying cirucits in the series being connected to the tone outputs of the keying circuit immediately preceding it in the series.

10. The organ of claim 9 wherein said keyer-divider circuits include serial data delay means for delaying said serial data stream by at least one octave and placing said delayed serial data stream on said serial data output, said keyer-divider serial data inputs and outputs being connected in series such that said serial data stream flows through said keyer-divider circuit in series and is successively delayed by the respective delay means.

11. The organ of claim 10 wherein said demultiplexer means each includes a shift register having its input connected to receive said serial data stream at the respective serial data input, and said delay means comprises a serial data output on said shift register on which the delayed serial data stream appears.

12. The electronic organ of claim 11 wherein said demultiplexer means each includes a plurality of latches connected between respective stages of its shift register and said keyer means, and including means for clocking said latches to transfer the data in said latches to said keyer means at the end of the scan of said keyboard.

13. The electronic organ of claim 10 wherein said serial data inputs and outputs are connected in series in the reverse order as the series connection of said tone inputs and outputs.

14. In an electronic organ or the like having a keyboard with playing keys, multiplexer means for scanning the keys and developing a serial data stream having keydown signals in time slots corresponding to depressed ones of the keys, and tone generator means for producing a plurality of tones, a keyer system comprising:

a plurality of keyer-divider circuits in the form of respective integrated circuit chips, each of said chips comprising a plurality of tone input pins and a plurality of tones output pins, divider means for dividing tones at the tone input pins so as to lower them by at least one octave, a serial data input pin and a serial data output pin, demultiplexer means for demultiplexing said serial data stream to produce a plurality of control signals corresponding to keydown signals in the serial data stream, serial data delay means for delaying said serial data stream by at least one octave and placing said delayed serial data stream on said serial data output, and keyer means controlled by said control signals and receiving tones on said tone input pins for receiving on a plurality of pitch output pins tones corresponding to said control signals, said chip tone input and output pins being connected in series with the tone input pins of the first chip being connected to said tone generator means and the tone input pins of successive chips in the series being connected to the tone output pins of the chip immediately preceding it in the series, said serial data input and output pins being connected in series such that the serial data stream flows through said chips in series and is successively delayed by the respective delay menas 15. The electronic organ of claim 14 wherein said keyer means each comprises attack and decay envelope generator means for imparting predetermined attack and decay characteristics to the tones keyed thereby, and including means for selecting the attack and decay characteristics comprising switch means external to the chips and tri-level encoder means controlled by said switch means for tri-level encoding of the signals on certain ones of said tone input pins.

16. The electronic organ of claim 15 wherein a plurality of said tri-level decoder means are connected between said tone generator means and certain tone input pins of said first chip.

17. The electronic organ of claim 15 wherein each of said chips includes: internal tri-level decoder means having inputs connected to said certain ones of the respective said tone input pins and having outputs, and internal tri-level encoder means having inputs connected to the outputs of said internal tri-level decoder means and having outputs, said internal tri-level encoder outputs of any one of said chips being connected to the internal tri-level inputs of another said chip.

18. The electronic organ of claim 14 wherein said serial data input and output pins are connected in series in the reverse order as the series connection of said tone input and output pins.

19. The electronic organ of claim 14 wherein each of said keyer-divider circuits pertains to the pitches of at least one octave and each of said pitch output pins carries a single footage for each pitch of the respective octave, with different footages appearing on the respective pitch output pins of each said keyer-divider circuit.

20. In an electronic organ or the like having a keyboard with playing keys, multiplexer means for scanning the keys and developing a serial data stream having keydown signals in time slots corresponding to depressed ones of the keys and tone generator means for producing a plurality of tones, a keyer system comprising:

a first keyer-divider circuit comprising a plurality of first tone inputs, first demultiplexer means having a serial data input connected to receive the serial data stream for demultiplexing the serial data stream and producing control signals corresponding respectively to the keydown pulses in one portion of said data stream, first keyer means responsive to said control signals and connected to receive tones on said tone inputs for producing on a plurality of output lines tones corresponding to said control signals, and a second keyer-divider circuit comprising a plurality of second tone inputs connected to receive said plurality of tones, a pluraity of tone outputs, divider means connected between said second tone inputs and said tone outputs for producing at the outputs tones corresponding to the tones on the second inputs lowered by at least one octave, second demultiplexer means having a serial data input connected to receive the serial data stream for demultiplexing the serial data stream and producing second control signals corresponding respectively to the keydown signals in another portion of the serial data stream, and a second keyer means connected to receive said second control signals and said plurality of tones for producing on a plurality of output lines tones corresponding to said second control signals, said first tone inputs being connected to said second keyer-divider tone outputs.

21. The electronic organ of claim 20 wherein said serial data stream is connected in parallel to said first and second demultiplexer means and wherein said first and second demultiplexer means demultiplexes only those portions of the serial data stream pertaining to said first and second keyer-divider circuits, respectively.

22. The electronic organ of claim 20 wherein said demultiplexer means each comprises a muntiple-stage shift register having a serial data input connected to receive said serial data stream and a plurality of control signal outputs on which the pertaining control signals appear connected respectively to a selected group of stages of said shift register.

23. In an electronic organ or the like having a keyboard with playing keys, multiplexer means for scanning the keys and developing a serial data stream having keydown signals in time slots corresponding to depressed ones of the keys, and tone generator means for producing a plurality of tones, a keyer system comprising:

a plurality of keyer-divider circuits in the form of respective integrated circuit chips, each of said chips comprising a plurality of tone input pins and a plurality of tone output pins, divider means for dividing tones at the tone input pins so as to lower them by at least one octave, a serial data input pin and a serial data output pin, demultiplexer means for demultiplexing said serial data stream to produce a plurality of control signals corresponding to keydown signals in the serial data stream, and keyer means controlled by said control signals and receiving tones on said tone input pins for receiving on a plurality of tone output pins tones corresponding to said control signals, said chip tone input and output pins being connected in series with the tone input pins of the first chip being connected to said tone generator means and the tone input pins of successive chips in the series being connected to the tone output pins of the chip immediately preceding it in the series.

* * * * *

UNITED STATES PATENT AND TRADEMARK OFFICE

CERTIFICATE OF CORRECTION

PATENT NO. : 4,217,801

DATED : August 19, 1980

INVENTOR(S) : Brian N. Wilcox and John W. Robinson

It is certified that error appears in the above-identified patent and that said Letters Patent are hereby corrected as shown below:

Column 1, line 50, change "forth" to --forty--.
Column 5, line 48, change "5v." to --+5v.--.
Column 8, line 17, change "enveloper" to --envelope--.
Column 9, line 56, change "out" to --output--.
Claim 9, column 12, line 30, change "tones" to --tone--(second occurrence)
Claim 9, column 12, line 46, change "cirucits" to --circuits--.
Claim 14, column 13, line 15, change "tones" to --tone --.
Claim 14, column 13, line 38, change "menas" to --means--.
Claim 20, column 14, line 23, change "pluraity" to --plurality--.
Claim 22, column 14, line 48, change "muntiple" to --multiple--.

Signed and Sealed this

*Twenty-fifth* Day of *November 1980*

[SEAL]

*Attest:*

SIDNEY A. DIAMOND

*Attesting Officer*

*Commissioner of Patents and Trademarks*